US006336635B1

(12) United States Patent
Baer

(10) Patent No.: US 6,336,635 B1
(45) Date of Patent: Jan. 8, 2002

(54) METHOD OF PLAYING A BLACKJACK CARD GAME

(76) Inventor: Larry M. Baer, 2520 Ridgewood Dr., W. Des Moines, IA (US) 50265

( * ) Notice: Subject to any disclaimer, the term of this patent is extended or adjusted under 35 U.S.C. 154(b) by 0 days.

(21) Appl. No.: 09/573,990

(22) Filed: May 17, 2000

(51) Int. Cl.[7] ..... A63F 1/00
(52) U.S. Cl. ..... 273/292; 273/274; 463/12
(58) Field of Search ..... 273/292, 274, 273/309; 463/12

(56) References Cited

U.S. PATENT DOCUMENTS 4,861,041 A * 8/1989 Jones
5,288,077 A * 2/1994 Jones
5,494,296 A * 2/1996 Grassa
5,769,422 A * 6/1998 Stromer
5,839,730 A * 11/1998 Pike
6,073,930 A * 6/2000 Jones .....

* cited by examiner

*Primary Examiner*—Benjamin H. Layno
*Assistant Examiner*—V K Mendiratta
(74) *Attorney, Agent, or Firm*—Micheal S. Neustel

(57) ABSTRACT

A method of playing a blackjack card game for providing a blackjack player the opportunity to control the subsequent cards dealt while simultaneously allowing all blackjack players to bet that the player is incorrect to win a share of a "progressive jackpot". The inventive device includes a game table having an area for player cards, a betting area for each player, a burn bet area for each player, a burn card area for receiving a burn card, and a container for receiving bets relating to a burn card. The game is played similarly to conventional blackjack except that each player is given the option of either (1) "passing", (2) "hitting", or (3) "burning" after their initial two cards are dealt. When "burning" a card, the player must place a "burn payment" within the container after which the dealer places the "burn card" from the deck face down within a burn card area of the game table. Each player is given the opportunity to place a burn bet within their respective burn bet area indicating they believe the burn card would have provided the burning player with "21". After the burn bets are placed, the dealer exposing the burn card. If the burn card would have provided the player with "21", then all of the players that placed a burn bet receive an equally divided portion of the tokens within the container. If the burn card would not have provided the player with "21", then the burn bets are collected by the dealer and placed within the container forming a progressive jackpot. The burning player is finally dealt the next card from within the deck of cards.

20 Claims, 5 Drawing Sheets

METHOD OF PLAYING A BLACKJACK CARD GAME

BACKGROUND OF THE INVENTION

1. Field of the Invention

The present invention relates generally to blackjack games and more specifically it relates to a method of playing a blackjack card game for providing a blackjack player the opportunity to control the subsequent cards dealt while simultaneously allowing all blackjack players to bet that the player is incorrect to win a share of a "progressive jackpot".

It is a common belief amongst the players of blackjack that they can determine when the next card being dealt from a deck of cards will be a card that will "bust" their hand (i.e. Provide them with a hand greater in value than "21"). With conventional blackjack players are limited to merely "passing" or "hitting" without allowing them any further control over the cards being dealt to them. Hence there is a need for a blackjack game that allows players to have a greater control over the cards being dealt to them along with allowing the other players of the table to financially benefit from any mistakes from the player.

2. Description of the Prior Art

Blackjack is a card game that has been played for years. Conventional blackjack comprises one or more players individually playing against the "house". More specifically, conventional blackjack comprises one face down card and one face up card dealt to each player and the dealer. With conventional blackjack, all players must place a minimum bet and attempt to receive a card combination that is equal to or slightly below "21". The object of conventional blackjack is to either (1) receive "21", (2) receive a hand greater in value than the house, or (3) remain under "21" with the house "bursting" or going over "21".

The main problem with conventional blackjack is that there is little interaction between the players since the game is based upon each individual player against the house to win or lose. Another problem with conventional blackjack is that a player is limited in the total amount they possibly can win by virtue of their independent bet without any residual winnings. Another problem with conventional blackjack is that it does not provide players the opportunity to at least partially control the card being dealt to them during a "hit".

Examples of patented card games include U.S. Pat. No. 5,494,296 to Grass; U.S. Pat. No. 5,154,429 to Vasseur; U.S. Pat. No. 5,257,810 to School et al.; U.S. Pat. No. 5,265,882 to Malek; U.S. Pat. No. 5,248,142 to Breeding; U.S. Pat. No. 5,098,107 to Boylan et al.; U.S. Pat. No. 5,280,915 to Groussman; U.S. Pat. No. 5,320,356 to Cauda; U.S. Pat. No. 5,395,120 to Malek; U.S. Pat. No. 5,452,899 to Skratulia et al. which are all illustrative of such prior art.

While these devices may be suitable for the particular purpose to which they address, they are not as suitable for providing a blackjack player the opportunity to control the subsequent cards dealt while simultaneously allowing all blackjack players to bet that the player is incorrect. Conventional blackjack games simply do not provide an incentive for players to remain at a table for a significant amount of time.

In these respects, the method of playing a blackjack card game according to the present invention substantially departs from the conventional concepts and designs of the prior art, and in so doing provides an apparatus primarily developed for the purpose of providing a blackjack player the opportunity to control the subsequent cards dealt while simultaneously allowing all blackjack players to bet that the player is incorrect.

SUMMARY OF THE INVENTION

In view of the foregoing disadvantages inherent in the known types of blackjack games now present in the prior art, the present invention provides a new method of playing a blackjack card game construction wherein the same can be utilized for providing a blackjack player the opportunity to control the subsequent cards dealt while simultaneously allowing all blackjack players to bet that the player is incorrect.

The general purpose of the present invention, which will be described subsequently in greater detail, is to provide a new method of playing a blackjack card game that has many of the advantages of the blackjack games mentioned heretofore and many novel features that result in a new method of playing a blackjack card game which is not anticipated, rendered obvious, suggested, or even implied by any of the prior art blackjack games, either alone or in any combination thereof.

To attain this, the present invention generally comprises a game table having an area for player cards, a betting area for each player, a burn bet area for each player, a burn card area for receiving a burn card, and a container for receiving bets relating to a burn card. The game is played similarly to conventional blackjack except that each player is given the option of either (1) "passing", (2) "hitting", or (3) "burning" after their initial two cards are dealt. When "burning" a card, the player must place a "burn payment" within the container after which the dealer places the "burn card" from the deck face down within a burn card area of the game table. Each player is given the opportunity to place a burn bet within their respective burn bet area indicating they believe the burn card would have provided the burning player with "21". After the burn bets are placed, the dealer exposing the burn card. If the burn card would have provided the player with "21", then all of the players that placed a burn bet receive an equally divided portion of the tokens within the container. If the burn card would not have provided the player with "21", then the burn bets are collected by the dealer and placed within the container forming a progressive jackpot. The burning player is finally dealt the next card from within the deck of cards.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a method of playing a blackjack card game that will overcome the shortcomings of the prior art devices.

A second object is to provide a method of playing a blackjack card game for providing a blackjack player the opportunity to control the subsequent cards dealt while simultaneously allowing all blackjack players to bet that the player is incorrect.

Another object is to provide a method of playing a blackjack card game that is based upon the common player belief that they can predict the value of the next card being dealt from a deck of cards.

An additional object is to provide a method of playing a blackjack card game that allows a number of players to place an additional bet that another player upon the table was wrong in their belief about the next card within the deck.

A further object is to provide a method of playing a blackjack card game that provides a "progressive jackpot" that may be shared by one or more players.

Another object is to provide a method of playing a blackjack card game that does not affect the basic odds of the game of blackjack.

A further object is to provide a method of playing a blackjack card game that encourages players to remain at a blackjack table at least until the progressive jackpot is divided.

An additional object is to provide a method of playing a blackjack card game that creates a group interest amongst players.

A further object is to provide a method of playing a blackjack card game that requires little additional training for dealers that have knowledge regarding conventional blackjack.

Another object is to provide a method of playing a blackjack card game that diminishes the "jealousy factor" often times found between players.

An additional object is to provide a method of playing a blackjack card game that can be played by one or more players.

Another object is to provide a method of playing a blackjack card game that allows players to financially benefit from the errors of other players.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
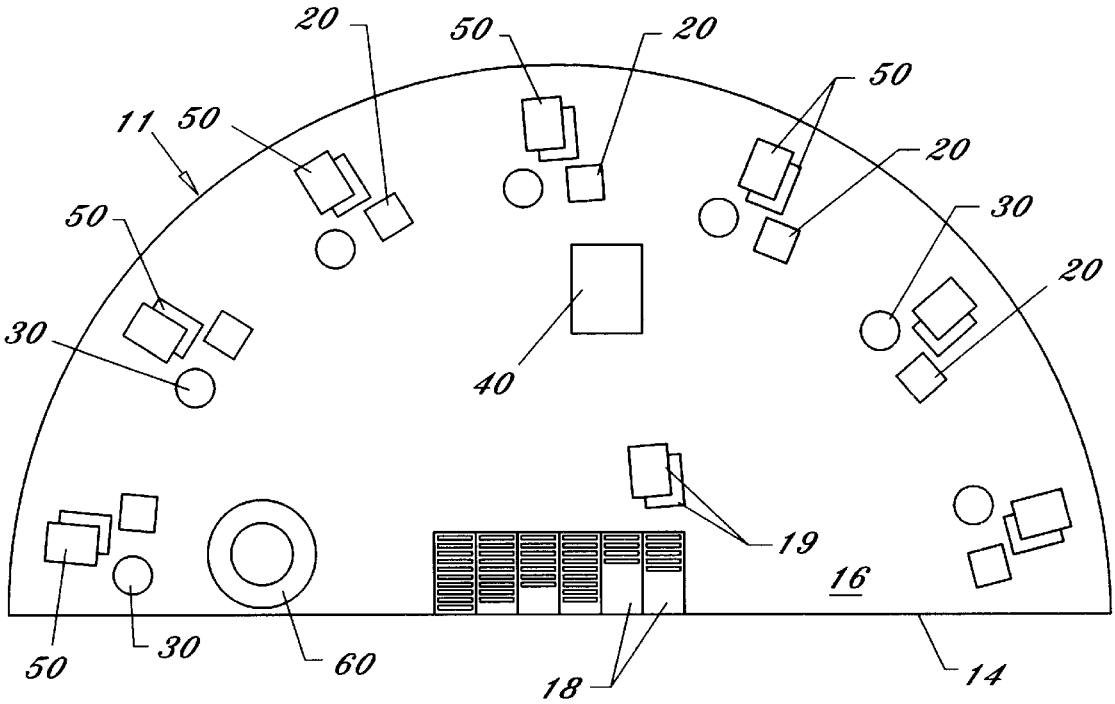
FIG. 1 is a top view of the game table for the present invention.

Turning now descriptively to the drawings, in which similar reference characters denote similar elements throughout the several views, FIGS. 1 through 4 illustrate a method of playing a blackjack card game 10, which comprises a game table 11 having an area for player cards 50, a betting area 30 for each player, a burn bet area 20 for each player, a burn card area 40 for receiving a burn card, and a container 60 for receiving bets relating to a burn card. The game is played similarly to conventional blackjack except that each player is given the option of either (1) "passing", (2) "hitting", or (3) "burning" after their initial two cards are dealt. When "burning" a card, the player must place a "burn payment" within the container 60 after which the dealer places the "burn card" from the deck face down within a burn card area 40 of the game table 11. Each player is given the opportunity to place a burn bet within their respective burn bet area 20 indicating they believe the burn card would have provided the burning player with "21". After the burn bets are placed, the dealer exposing the burn card. If the burn card would have provided the player with "21", then all of the players that placed a bum bet receive an equally divided portion of the tokens within the container 60. If the burn card would not have provided the player with "21", then the burn bets are collected by the dealer and placed within the container 60 forming a progressive jackpot. The burning player is finally dealt the next card from within the deck of cards.

A. Game Table

Figure 2:
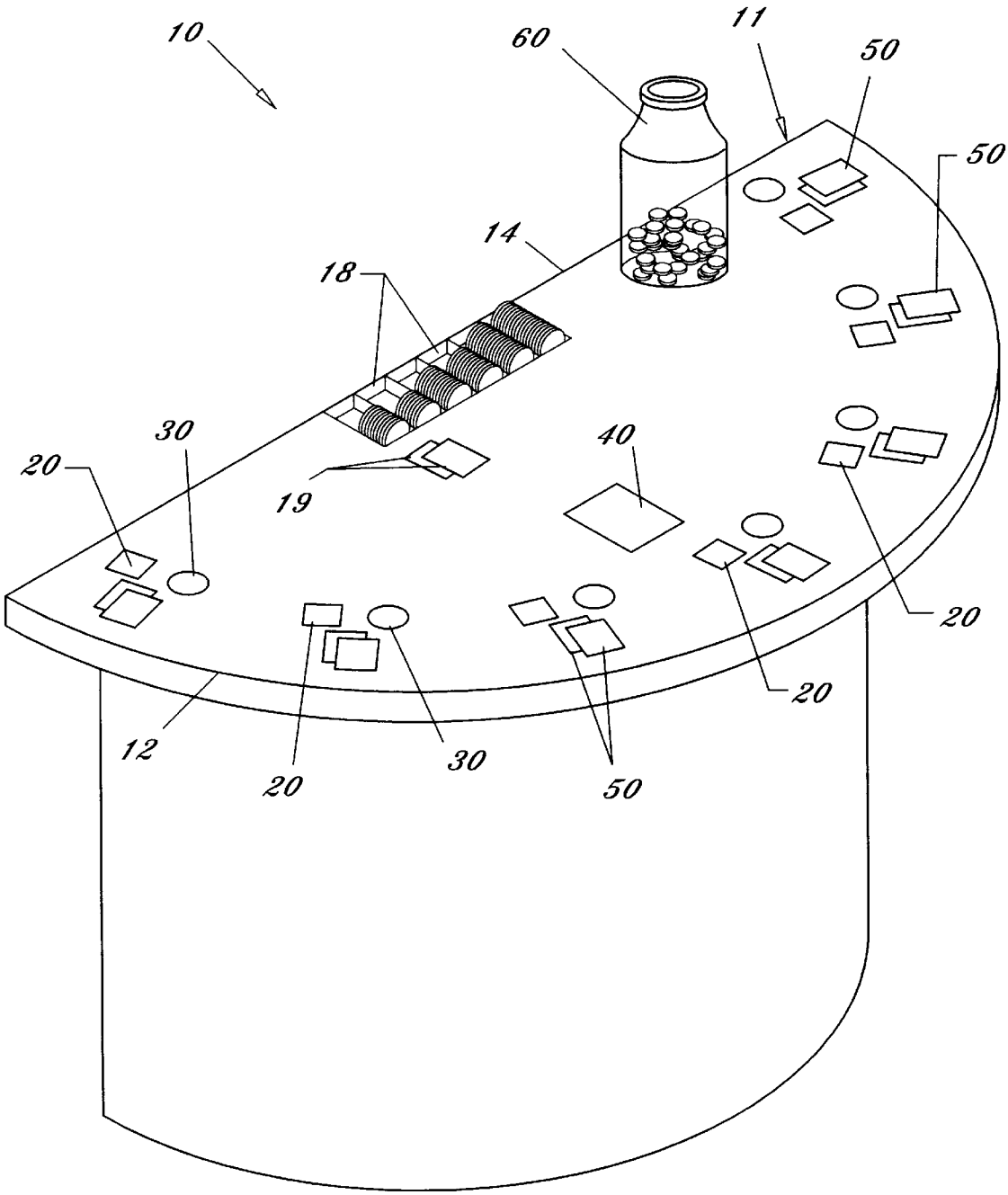
FIG. 2 is a front upper perspective view of the game table for the present invention.

As shown in FIGS. 1 and 2 of the drawings, the game table 11 has a curved side 12 for accommodating up to seven players and a straight side 14 for accommodating a dealer. The game table 11 has a flat surface 16 covered with felt or other appropriate material. Although seven playing positions for individual players are provided upon the game table 11, it is not essential to the game that exactly seven individuals play and as many players who may be positioned about the game table 11 may participate.

A chip tray 18 is preferably positioned in front of the dealer. An area in front of the chip tray 18 is the burn area 18 as best shown in FIG. 1 of the drawings. Each of the playing positions includes a betting area 30 and an area to position the player cards 50. There may also be a payout schedule that discloses to the players the winning card combinations and the appropriate payouts.

As further shown in FIGS. 1 and 2 of the drawings, there is an area for each player to receive the player cards 50 that are dealt. In front of each of the areas for the player cards 50 is a betting area 30 for receiving the initial bet and any subsequent bets by each player as commonly found with a conventional blackjack table. As further shown in FIGS. 1 and 2 of the drawings, there is an area in front of the chip tray for receiving the dealer cards 19 commonly found with conventional black jack tables.

As further shown in FIGS. 1 and 2 of the drawings, each of the player positions further includes a burn bet area 20 for receiving burn bets. A burn card area 40 is provided upon the game table 11 for receiving the burn card after a player decides to "burn" instead of hitting or passing.

It can be appreciated by one skilled in the art that this method of playing a blackjack game can also be operated upon a gaming machine, computer, video game machine or the like. The following discussion will discuss the use of a game table 11 for the sake of brevity and clarity though it can be appreciated that the useful game may be implemented and operated upon various platforms.

B. Container

Figure 3:
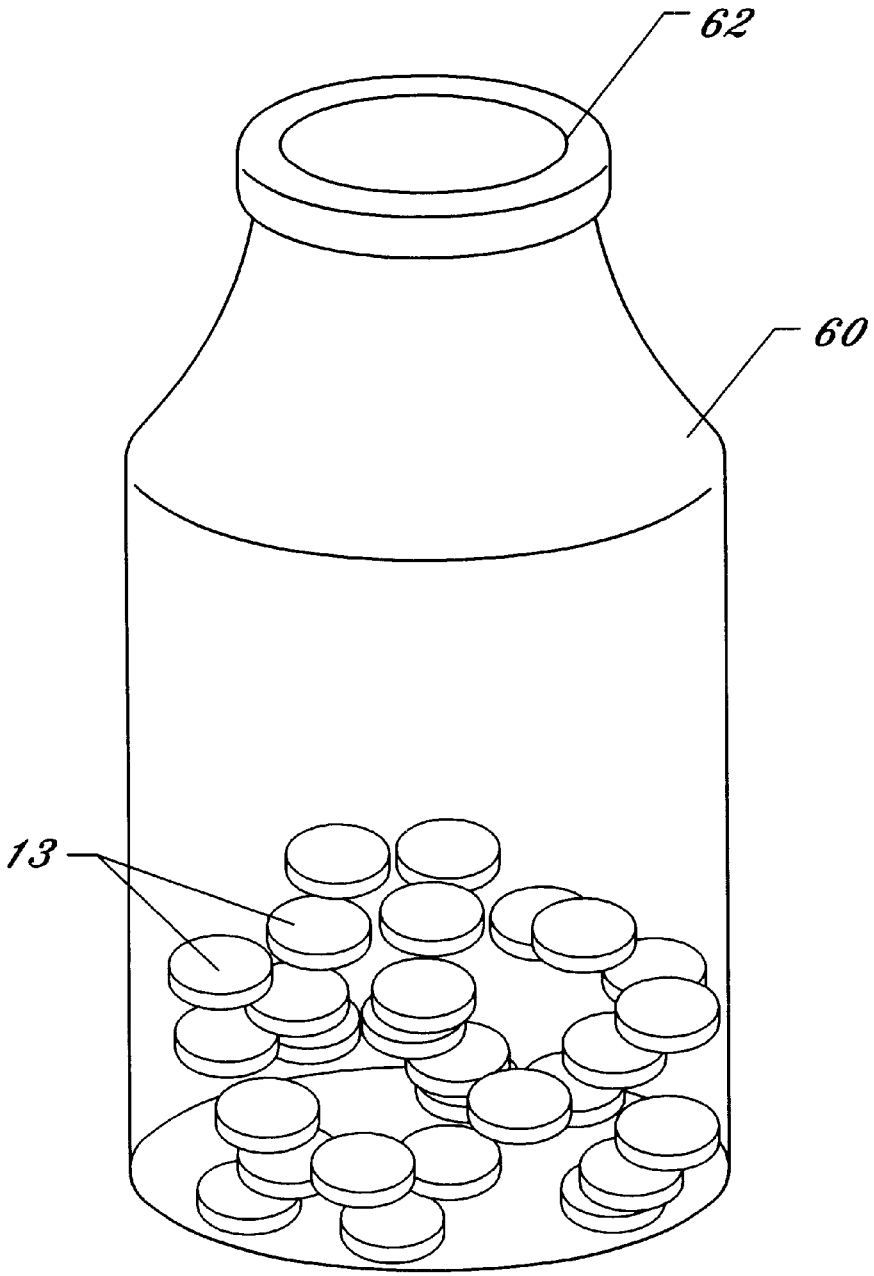
FIG. 3 is an upper perspective view of the container for receiving the burn bets.

As shown in FIGS. 1 through 3 of the drawings, a container 60 is provided that receives the burn payment and the burn bets from the players thereby creating a "progressive jackpot" for everyone to see. The container 60 includes an upper opening 62 for receiving tokens and the like.

The container 60 is preferably constructed of a transparent or semi-transparent material such as plastic or glass for allowing the players to receive a visual indication of the total amount of money contained within the container 60 thereby enticing the players to remain at the game table 11 longer. Additional electronic means may be provided for indicating the total amount of money within the container 60 such as an LED or LCD display.

C. Rules and Operation

1. Placing Initial Bets and Dealing of Cards

Figure 4A:
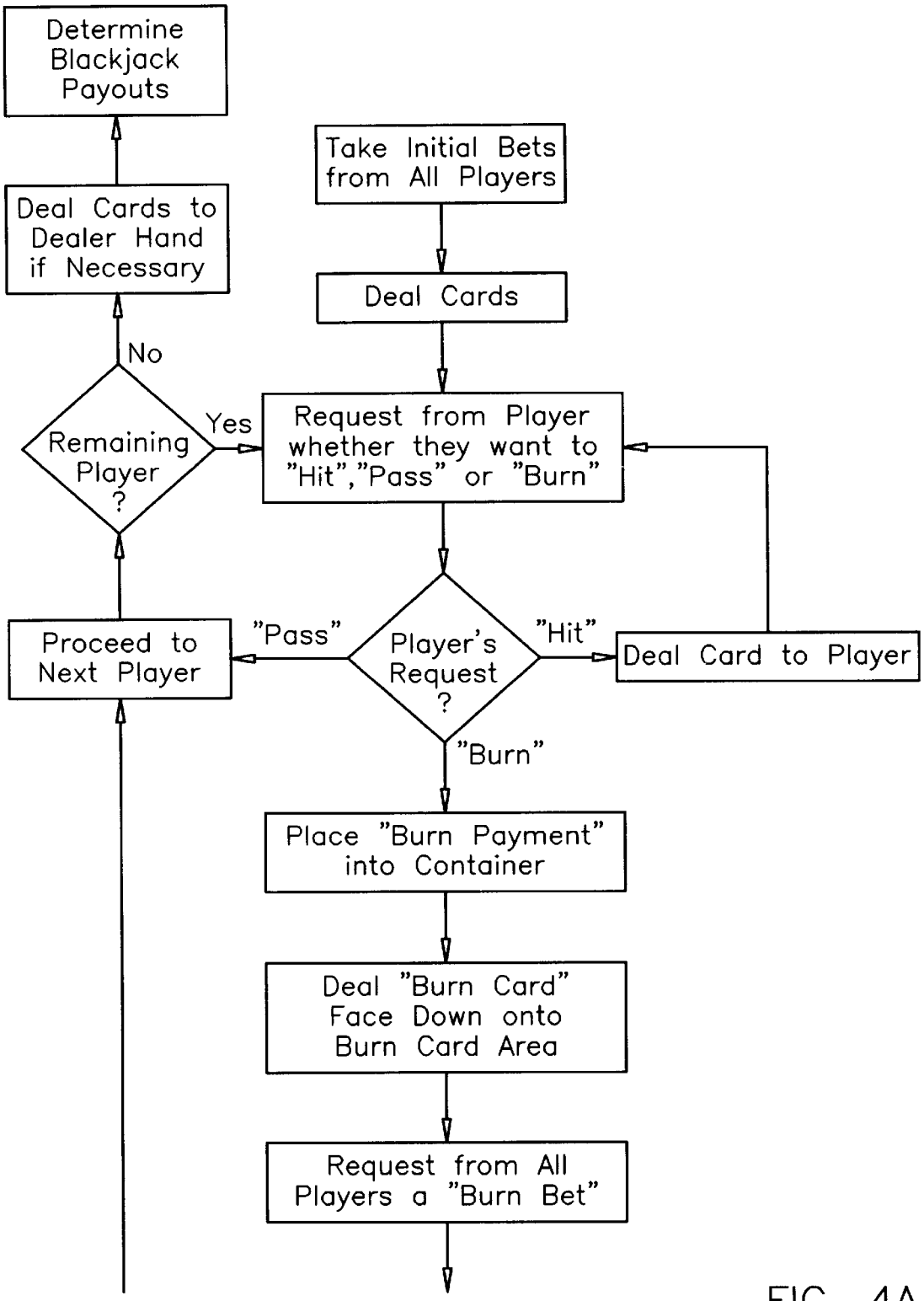
FIG. 4 is a flowchart illustrating the operation of the present invention.
Figure 4B:
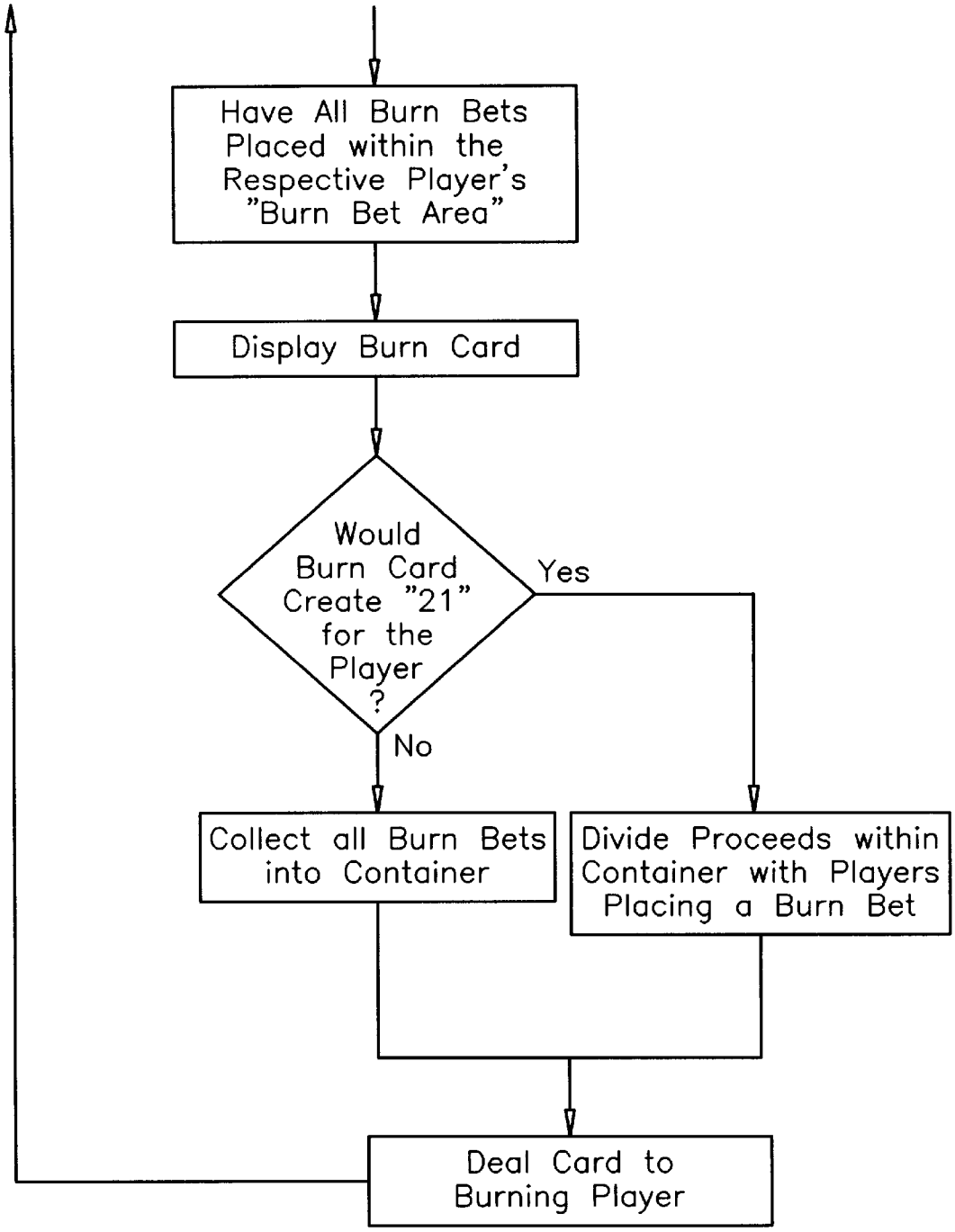

As shown in FIG. 4 of the drawings, the first step is for all participating players to place an initial wager as is common with most blackjack games. This initial bet allows each player to participate in the blackjack game.

Upon receiving the initial bets, the dealer then deals the cards to each of the participating players and to the deal. More specifically, the dealer typically deals one face down card and one face up card to each of the players and themselves. Each of the players can see the other players' face up cards which provides them an indication of the cards remaining within the deck of cards.

2, "Hit", "Pass", or "Burn"

As further shown on FIG. 4 of the drawings, each player is provided with the opportunity to either pass, take a hit, or "burn". If the player decides to "pass", the dealer proceeds to the next player as shown in FIG. 4 of the drawings.

If the player decides to take a "hit" the dealer then deals to the player the next card within the deck of cards. The player is then presented with the same three options regarding the next card within the deck of cards—pass, hit or burn. If the player decides to pass, the dealer proceeds to the next player. If the player decides to take a hit, the above process is repeated again for the player.

3. Burning a Card

If a player believes that the next card to be dealt will "bust" them, they may desire to "burn" the card and receive the second card within the deck of cards instead. If the player decides to "burn" the next card within the deck of cards, the player is requested by the dealer to make a "burn payment" which is placed into the container 60. The burn payment typically is comprised of the minimum bet for the table, however the burn payment may be comprised of different rates as can be appreciated by one skilled in the art.

4. Burn Bets

Once the dealer receives the burn payment, the dealer then deals the next card from the deck of cards face down onto the burn card area 40 so that none of the players may see the card. The dealer then requests from each of the players, including the burning player, as to whether they would like to place a "burn bet". If no players place a burn bet, then the dealer simply discards the bum card and continues play.

5. Calculating Payouts for Burn Card Participants

If one or more players place a burn bet within their respective burn bet area 20 upon the game table 11, the dealer then flips the burn card to show the value of the burn card to all of the players. If the value of the burn card does not create a value of "21" for the burning player, the dealer then collects the burn bets from all of the players and places the burn bets into the container 60 which contains the progressive jackpot.

If the value of the burn card would have created a value of "21" for the burning player, then all players that placed a burn bet will receive an equal amount of the progressive jackpot stored within the container 60. The dealer thereafter removes the tokens or other items from within the container 60 and determines the total value contained within. The dealer then divides the total value of the progressive jackpot by the total number of players that placed a burn bet thereby determining the payout for each of the players that placed a burn bet. The dealer then provides each of the players who placed a burn bet with the required payout from the progressive jackpot.

The dealer then deals the subsequent card within the deck of cards to the player who placed the burn payment. The player may "burn" only one card per hand, so the player's only options after burning a card is to either pass or take another hit.

6. Normal Play is Continued

The dealer then proceeds with the remaining players with the same process until all players have had an opportunity to pass, hit or burn. The dealer then exposes its face down card and deals itself cards additional cards if required by the rules of conventional blackjack. The players are then paid out as with conventional blackjack depending upon their respective hands in view of the dealer's hand.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a blackjack card game, comprising the steps of:

(a) receiving an initial bet from at least one player;

(b) dealing two cards to said at least one player and to a house from a deck of cards;

(c) requesting from a player whether they want to either (i) pass, (ii) take a hit, or (iii) burn a card;

(d) receiving a burn payment from said player if said player selects (iii) burn a card and placing said burn payment into a progressive jackpot;

(e) dealing a burn card face down onto a burn card area of said game table;

(f) receiving burn bets from participating players;

(g) displaying value of said burn card;

(h) determining a combined value of said burn card with the cards of said player;

(i) collecting said burn bets if said combined value is not equal to a value of 21 and placing said burn bets into said progressive jackpot; and (j) distributing said progressive jackpot to said participating players if said combined value equals a value of 21.

2. The method of playing a blackjack card game of claim 1, including the step of:

(k) dealing a subsequent card to said player.

3. The method of playing a blackjack card game of claim 2, including the step of:

(1) repeating steps (c) through (k) for a subsequent player.

4. The method of playing a blackjack card game of claim 1, wherein said burn payment is comprised of a minimum table bet.

5. The method of playing a blackjack card game of claim 1, wherein said burn bet is comprised of a minimum table bet.

6. The method of playing a blackjack card game of claim 1, wherein said progressive jackpot is contained within a container.

7. The method of playing a blackjack card game of claim 6, wherein said container is transparent.

8. The method of playing a blackjack card game of claim 6, wherein said container is semi-transparent.

9. The method of playing a blackjack card game of claim 1, wherein said deck of cards is comprised of 52 cards.

10. The method of playing a blackjack card game of claim 1, wherein said progressive jackpot is evenly distributed to said participating players in step (j).

11. A method of playing a blackjack card game, comprising the steps of:

(a) providing a game table having a betting area, a burn bet area and a burn card area;

(b) receiving an initial bet from at least one player;

(c) dealing two cards to said at least one player and to a house from a deck of cards;

(d) requesting from a player whether they want to either (i) pass, (ii) take a hit, or (iii) burn a card;

(e) receiving a burn payment from said player if said player selects (iii) burn a card and placing said burn payment into a progressive jackpot;

(f) dealing a burn card face down onto a burn card area of said game table;

(g) receiving burn bets from participating players;

(h) displaying value of said burn card;

(i) determining a combined value of said burn card with the cards of said player;

(j) collecting said burn bets if said combined value is not equal to a value of 21 and placing said burn bets into said progressive jackpot; and (k) distributing said progressive jackpot to said participating players if said combined value equals a value of 21.

12. The method of playing a blackjack card game of claim 11, including the step of:

(1) dealing a subsequent card to said player.

13. The method of playing a blackjack card game of claim 12, including the step of:

(m) repeating steps (d) through (1) for a subsequent player.

14. The method of playing a blackjack card game of claim 11, wherein said burn payment is comprised of a minimum table bet.

15. The method of playing a blackjack card game of claim 11, wherein said burn bet is comprised of a minimum table bet.

16. The method of playing a blackjack card game of claim 11, wherein said progressive jackpot is contained within a container.

17. The method of playing a blackjack card game of claim 16, wherein said container is transparent.

18. The method of playing a blackjack card game of claim 16, wherein said container is semi-transparent.

19. The method of playing a blackjack card game of claim 11, wherein said progressive jackpot is evenly distributed to said participating players in step (k).

20. A method of playing a blackjack card game, comprising the steps of:

(a) providing a game machine, wherein said game machine includes a visual display capable of displaying player information and cards;

(b) receiving an initial bet from at least one player;

(c) dealing two cards to said at least one player and to a house;

(d) requesting from a player whether they want to either (i) pass, (ii) take a hit, or (iii) burn a card;

(e) receiving a burn payment from said player if said player selects (iii) burn a card and placing said burn payment into a progressive jackpot;

(f) dealing a burn card face down onto a burn card area;

(g) receiving burn bets from participating players;

(h) displaying value of said burn card;

(i) determining a combined value of said burn card with the cards of said player;

(j) collecting said burn bets if said combined value is not equal to a value of 21 and placing said burn bets into said progressive jackpot; and (k) distributing said progressive jackpot to said participating players if said combined value equals a value of 21.

* * * * *